United States Patent [19]

Muse

[11] Patent Number: 4,503,567

[45] Date of Patent: Mar. 12, 1985

[54] PARTIALLY STIFFENED EXTENSIBLE WAISTBAND STRUCTURE

[75] Inventor: Ralph F. Muse, Bremen, Ga.

[73] Assignee: Hubbard Company, Bremen, Ga.

[21] Appl. No.: 555,467

[22] Filed: Nov. 28, 1983

[51] Int. Cl.[3] ..... A41F 9/02

[52] U.S. Cl. ..... 2/237; 2/76; 2/220; 2/236

[58] Field of Search ..... 2/236, 237, 221, 220, 2/76

[56] References Cited

U.S. PATENT DOCUMENTS

| | | | |
|---|---|---|---|
| 1,396,462 | 11/1921 | Pugatsky et al. | 2/236 |
| 2,195,894 | 4/1940 | Moore | 2/237 |
| 2,277,227 | 3/1942 | Hardie | 2/237 |
| 2,438,804 | 3/1948 | Hardie | 2/237 |
| 2,745,107 | 5/1956 | Gemignani | 2/236 |
| 2,757,381 | 8/1956 | Le Cottier et al. | 2/237 |
| 3,129,434 | 4/1964 | Weemhoff | 2/236 |
| 3,221,346 | 12/1965 | Johnson et al. | 2/236 |
| 3,422,461 | 1/1969 | Froelich | 2/236 |
| 3,427,661 | 2/1969 | Navasky | 2/236 |
| 3,559,213 | 2/1971 | Goodman | 2/237 |
| 3,663,963 | 5/1972 | Miller | 2/237 |
| 3,723,993 | 4/1973 | Ruby | 2/237 |
| 3,788,365 | 1/1974 | Campbell et al. | 2/237 |
| 3,800,332 | 4/1974 | Forrest | 2/237 |
| 3,842,437 | 10/1974 | Campbell et al. | 2/237 |
| 3,869,728 | 3/1975 | Spencer | 2/237 |
| 4,193,136 | 3/1980 | Pierce | 2/237 |
| 4,332,034 | 6/1982 | Muse | 2/237 |

*Primary Examiner*—Werner H. Schroeder
*Assistant Examiner*—Mary A. Ellis
*Attorney, Agent, or Firm*—Kilpatrick & Cody

[57] ABSTRACT

A garment waistband that employs a longitudinally extensible elastic band which is laterally partially stiffened. A plurality of elastic threads extending in the longitudinal direction through the band are bound to stiffened lateral fibers, and the stiffened lateral fibers are loosely interconnected by supporting fibers. The extension of the elasic band is partially restrained by a fabric web attached to parts of the inner and outer surfaces of the elastic band. The looseness with which the supporting fibers connect the stiffened fibers allows one longitudinal portion of the waistband to be stretched without significantly affecting nearby parallel longitudinal portions. The fabric web partially restrains extension of the elastic band so that the garment to which it is attached does not pucker or significantly deform. The result is a waistband that conforms in a comfortable manner to body contours while providing stability and a neat, finished appearance to the garment in which it is employed.

16 Claims, 6 Drawing Figures

PARTIALLY STIFFENED EXTENSIBLE WAISTBAND STRUCTURE

BACKGROUND OF THE INVENTION

This invention relates to a garment waistband that employs a longitudinally extensible elastic band which is laterally partially stiffened. The extension of the elastic band is restrained by a fabric web attached to parts of the inner and outer surfaces of the elastic band.

Waistbands and structures employing elastic bands are well known in the prior art. Such waistbands characteristically are intended to provide a snug, comfortable fit while eliminating the need for a belt. A problem experienced with such waistbands, however, is that their upper portions tend to roll outwardly over themselves, especially when worn by individuals with significant body fat in their waist and pelvic regions. This rolling tendency has been addressed by several designs.

One design for garment waistbands aimed at offering greater resistance to rolling employs an elastic band having a cross section which is concave on its inner surface. The top portion, being of smaller circumference around the wearer than the lower portions, naturally resists rolling down and over those portions. Such a waistband can result in discomfort, however, if its top edges press too strongly into the waist of the wearer.

Another roll-resistant waistband employs a two part elastic band. The upper part of the elastic band is uniformly less extensible than the lower portion. In this manner, the upper portion of the waistband, whose vertical width is insufficient to allow rolling, but great enough not to cut into the wearer, fits the garment snugly to the wearer, while the lower portion acts as a skirt, conforming to the body of the wearer for a comfortable fit. Such a waistband is disclosed in my earlier U.S. Pat. No. 4,332,034 issued June 1, 1982.

Another waistband structure employs an elastic band generally covered by a fabric web. The web is omitted, however, in the areas near the side seams of the garment employing the waistband. The segments of the upper portion of the elastic band to which the fabric web is attached are partially constrained from elongation by the fabric web, while the areas of the elastic band not attached to the fabric web are free to stretch.

Other efforts directed at alleviating the roll-over problem and providing a comfortable fit include placing semi-rigid stays in the waistband structure. These bands, however, can result in discomfort to the wearer, particularly when the garment employing such a waistband is worn for long periods of time.

SUMMARY OF THE INVENTION

The waistband of the present invention employs an elastic band having many elastic threads extending in the longitudinal direction. In addition, stiffened fibers extend in the lateral direction across the band. Supporting fibers extending generally in the longitudinal direction bind the stiffened fibers to the elastic threads, and loosely interconnect the stiffened fibers. The elastic band therefore resists bending in the vertical direction and stretches in the longitudinal direction. Because of the looseness with which the supporting fibers connect the stiffened fibers, one longitudinal portion of the band may be stretched without significantly affecting nearby parallel longitudinal portions. This structure allows the band to conform in a comfortable manner to body contours.

The elastic band in the present invention is partially restrained from extension by a fabric web. The fabric web covers the entire inner surface and the upper outer surface of the elastic band. The fabric web is attached to the inner surface of the elastic band near the top of the band, at approximately the middle, and near the bottom. It is also attached to the outer surface of the band near the middle of the band. The result is that two layers of fabric web cover the upper portion of elastic band; one on the inner surface and one on the outer surface. One layer covers the lower portion of the elastic band, on the inner surface. The elastic web, which may be of the same fabric as the garment body, is also extensible, although in the present invention it is not as easily stretched as the elastic band. The three lines of attachment of the fabric web to the inner surface of the elastic band, the line of attachment of the web to the outer surface of the band and the fabric web itself, therefore controllably restrain the extent to which the elastic band may stretch. Because the fabric web in the preferred embodiment comprises material of which the garment body is made or having stretch properties similar to such material, the ability of the resulting waistband structure to stretch comports approximately with the ability of the garment body to stretch, reducing deformation of the garment body.

It is therefore an object of the present invention to provide a partially stiffened garment waistband which eliminates the need for a belt and which is comfortable to the wearer but which resists rolling of the waistband over the outer portion of the garment.

It is a further object of the present invention to provide a partially stiffened garment waistband which is comfortable to the wearer but which fits the wearer sufficiently snugly to support the garment on the wearer's body, even in cases when he or she has experienced a weight gain or loss which might otherwise cause discomfort or a poor fit.

It is another object of the present invention to provide a partially stiffened garment waistband, the upper portion of which provides greater resistance to elongation approximating such resistance offered by the garment body, and the lower portion of which offers lesser resistance to elongation.

Yet a further object of the present invention is to provide a garment waistband which is attractive in appearance and is relatively simple to manufacture.

Other objects and advantages of the present invention will become apparent during the course of the following description.

DETAILED DESCRIPTION OF THE DRAWINGS

Figure 1:
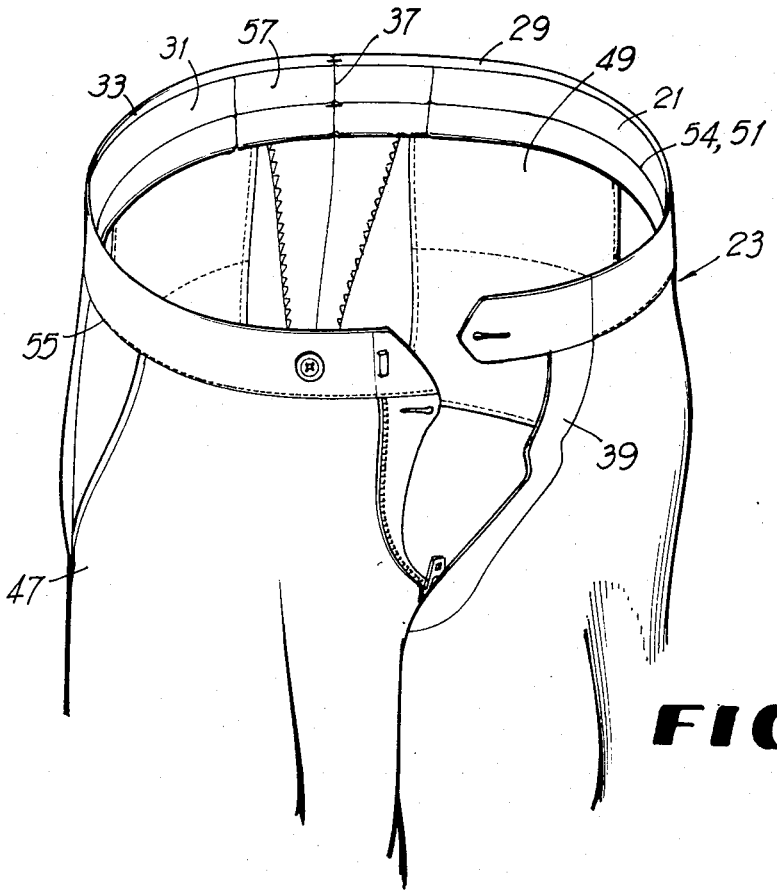
FIG. 1 is a perspective view of the upper portion of a garment employing a waistband of the present invention.

FIG. 1 shows the arrangement of one embodiment of the waistband structure 21 of the present invention in relation to a garment 23 in which it is employed. Waistband structure 21 is generally located in the top portion of garment 23. It generally comprises an elastic band 27 and a fabric web 29 covering portions of elastic band 27. Garment 23 may be any type of garment which is at least partially suspended or supported from a body, including trousers, a skirt or athletic wear, and in the depicted embodiment, garment body 35 includes a seat seam 37, a fly 39 and pockets 49.

Elastic band 27 comprises elastic threads extending in the longitudinal direction, and stiffened fibers extending laterally across the width of the elastic band 27. Supporting threads bind the elastic threads to the stiffened fibers, and loosely connect adjacent rows of stiffened fibers. Because of this structure, portions of elastic band 27 may be stretched without significantly affecting the extension of nearby longitudinal portions. Furthermore, the stiffened fibers extending laterally across elastic band 27, or vertically when elastic band 27 is installed in garment 23 and worn, allow elastic band 27 to resist "rollover," so that garment 23 will not roll over on itself when worn by persons having significant body fat in their midriff regions. In the preferred embodiment, elastic band 27 is obtained from United Elastic in Stuart, Va., and is styled "7021 Quality Woven Elastic Band."

Figure 4:
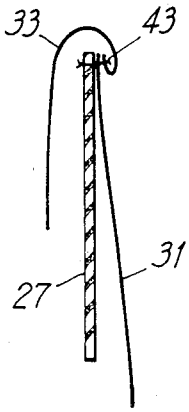
FIG. 4 is a schematic elevational cross section view of the elastic band of the present invention showing attachment of the fabric web to the band.
Figure 5:
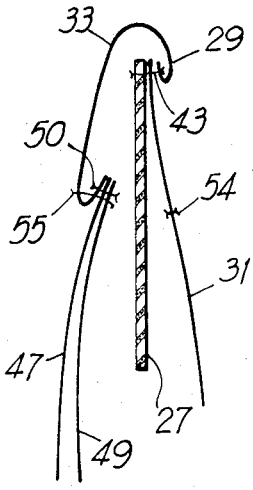
FIG. 5 is a schematic elevational cross section view of the elastic band of FIG. 4 further showing attachment of the garment body and pockets to the fabric web.

Fabric web 29 partially covers elastic band 27. Fabric web 29 has two portions, an inner web portion 31 and an outer web portion 33. These web portions may be seen clearly in FIGS. 4–6. The upper linear parts of each of inner fabric web portion 31 and outer fabric web portion 33 are attached by a first securing means 43 to the upper inner linear part of elastic band 27. In the depicted embodiment, the bottom edge of outer fabric web portion 33 is attached or sewn to garment body 47 and pockets 49 by a sixth securing means 50. It is then tucked under and attached to elastic band 27 and inner fabric web portion 31 by second securing means 51, shown in FIG. 6. The bottom edge of inner fabric web portion 31 is tucked under elastic band 27 and attached to the lower outer part of elastic band 27 by third securing means 53.

First securing means 43, second securing means 51, third securing means 53 and sixth securing means 50 may be lines of stitching, heat binding, glueing or other appropriate means. In the preferred embodiment, they are lines of chain stitching.

A decorative fourth line of stitching 54 may be placed through the middle part of inner fabric web portion 31. A decorative fifth line of stitching 55 may be placed through the lower part of outer fabric web portion 33 to improve further the appearance of garment 23.

A conventional or other type outlet 57 may be placed in garment 23 in the vicinity of seat seam 37. In such an embodiment, the waistband structure 21 is elastic around the sides of the wearer, but is not elastic in the vicinity of the small of his or her back.

Figure 6:
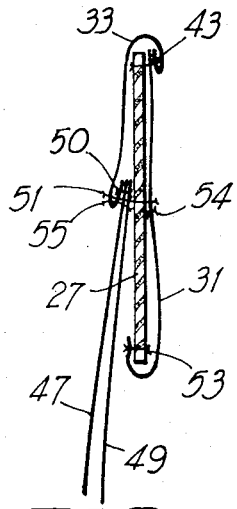
FIG. 6 is an elevational cross sectional view of the waistband of the garment of FIG. 3, taken along 6—6 of FIG. 3.

FIG. 6 shows that two portions of fabric web 29 are attached to and restrain the upper part of elastic band 27. Only one portion of fabric web 29 is attached to and restrains extension of the lower part of elastic band 29. FIG. 6 also shows that garment body 47 and pockets 49 are attached to the bottom edge of the upper part of elastic band 27 which is restrained by two portions of fabric web 29. This construction allows the lower part of elastic band 27 to stretch more easily than the upper part, to which garment body 47 and pockets 49 are attached. In this manner waistband structure 21 comfortably conforms to the hip structure and body contours of the wearer, while not puckering the fabric of garment body 47 to cause unsightly outward appearance.

Figure 2:
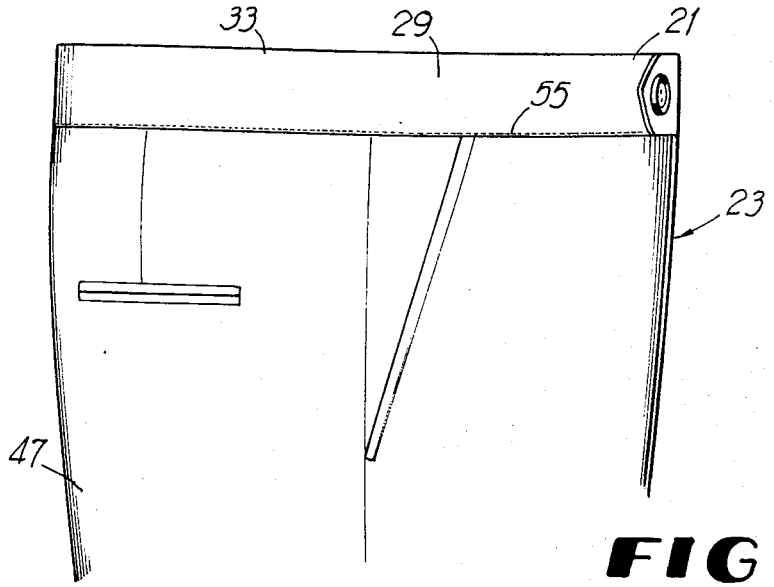
FIG. 2 is a side elevational view of the right side of the garment of FIG. 1.

FIG. 2 shows the finished appearance of a pair of trousers having the waistband structure of the present invention. Fifth line of stitching 55 can be seen along the lower part of outer web portion 33.

Figure 3:
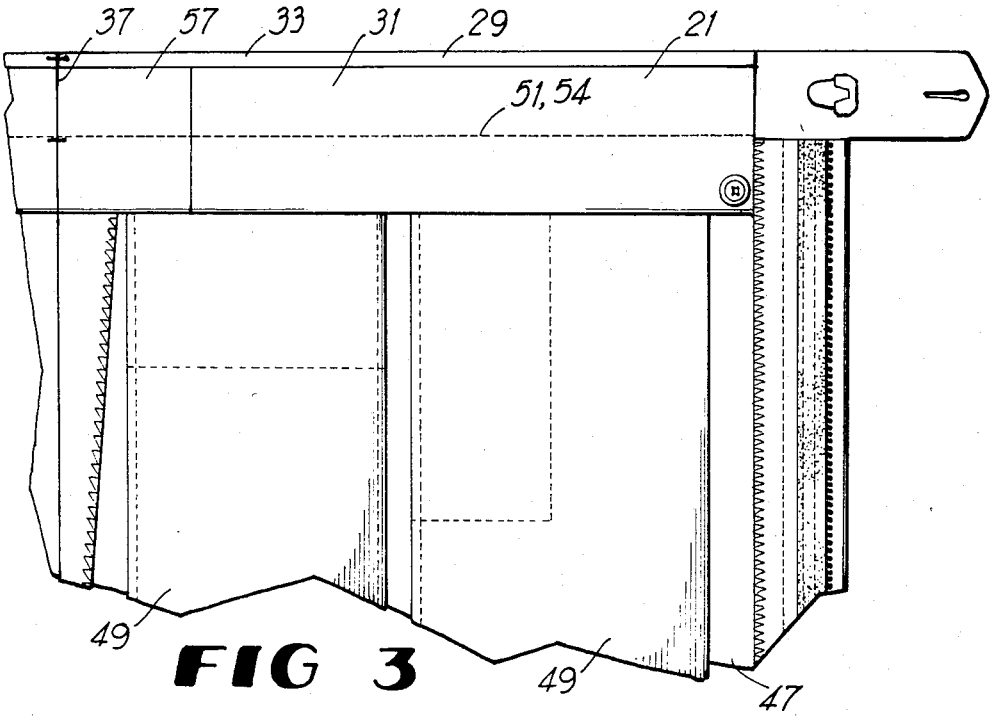
FIG. 3 is a schematic side elevational view of part of the inside surface of the left hand side of the garment of FIG. 1.

FIG. 3 shows the finished appearance of the interior of the depicted embodiment of the waistband structure 21 of the present invention. Fourth line of stitching 54 can be seen extending through the middle part of inner fabric web portion 31 and outlet 57.

The foregoing description of the present invention is for purposes of explanation and illustration. It will be apparent to those skilled in the relevant art that modifications and changes may be made to the invention as thus described without departing from its scope and spirit.

I claim:

1. A garment waistband structure comprising:
   (a) an elastic band comprising:
      (i) a plurality of stiffened fibers oriented laterally across the band;
      (ii) a plurality of elastic threads oriented longitudinally through the band;
      (iii) a plurality of fibers oriented longitudinally which bind the stiffened fibers to the elastic threads and which loosely interconnect the stiffened fibers;
   (b) a partially extensible fabric web partially covering the elastic band comprising:
      (i) an outer web portion; and
      (ii) an inner web portion;
   (c) a first securing means securing upper linear parts of the outer web portion and the inner web portion to upper linear parts of the inner surface of the elastic band;
   (d) a second securing means securing lower linear parts of the outer web portion and middle linear parts of the inner web portion to the elastic band; and
   (e) a third securing means securing lower linear parts of the inner web portion to lower linear parts of the outer surface of the elastic band.

2. A garment waistband structure according to claim 1 further comprising an outlet near the rear part of said waistband structure.

3. A garment waistband structure according to claim 1 further comprising a decorative line of stitching penetrating the lower linear part of said outer fabric web portion.

4. A garment waistband structure according to claim 3 further comprising a decorative line of stitching penetrating the middle linear part of said inner fabric web portion.

5. A garment waistband structure according to claim 1 wherein said first, second and third securing means comprise first, second and third lines of stitching.

6. A garment waistband structure comprising:
(a) an elastic band comprising:
(i) a plurality of stiffened fibers oriented laterally across the band;
(ii) a plurality of elastic threads oriented longitudinally through the band;
(iii) a plurality of fibers oriented longitudinally which bind the stiffened fibers to the elastic threads and which loosely interconnect the stiffened fibers;
(b) a partially extensible fabric web partially covering the elastic band comprising:
(i) an outer web portion; and
(ii) an inner web portion;
(c) a first line of stitching securing upper linear parts of the outer web portion and the inner web portion to upper linear parts of the inner surface of the elastic band;
(d) a second line of stitching securing lower linear parts of the outer web portion, and middle linear parts of the inner web portion, to the elastic band;
(e) a third line of stitching securing lower linear parts of the inner web portion to lower linear parts of the outer surface of the elastic band;
(f) a decorative fourth line of stitching penetrating the lower linear part of the outer fabric web portion;
(g) a decorative fifth line of stitching penetrating the middle linear part of the inner fabric web portion; and
(h) an outlet located near the rear part of said waistband structure.

7. A garment comprising:
I. a garment waistband structure comprising:
(a) an elastic band comprising:
(i) a plurality of stiffened fibers oriented laterally across the band;
(ii) a plurality of elastic threads oriented longitudinally through the band;
(iii) a plurality of fibers oriented longitudinally which bind the stiffened fibers to the elastic threads and which loosely interconnect the stiffened fibers;
(b) a partially extensible fabric web partially covering the elastic band comprising:
(i) an outer web portion; and
(ii) and inner web portion;
(c) a first securing means securing upper linear parts of the outer web portion and the inner web portion to upper linear parts of the inner surface of the elastic band;
(d) a second securing means securing lower linear parts of the outer web portion and middle linear parts of the inner web portion to the elastic band; and
(e) a third securing means securing lower linear parts of the inner web portion to lower linear parts of the outer surface of the elastic band; and
II. a garment body attached proximate its upper linear edge to lower linear parts of the outer fabric web portion.

8. A garment according to claim 7 further comprising an outlet near the rear part of said waistband structure.

9. A garment according to claim 7 wherein said first, second and third securing means comprise first, second and third lines of stitching.

10. A garment according to claim 7 further comprising a decorative fourth line of stitching penetrating the lower linear part of said outer fabric web portion.

11. A garment according to claim 10 further comprising a decorative fifth line of stitching penetrating the middle linear part of said inner fabric web portion.

12. Trousers comprising:
I. a garment waistband structure comprising:
(a) an elastic band comprising:
(i) a plurality of stiffened fibers oriented laterally across the band;
(ii) a plurality of elastic threads oriented longitudinally through the band;
(iii) a plurality of fibers oriented longitudinally which bind the stiffened fibers to the elastic threads and which loosely interconnect the stiffened fibers;
(b) a partially extensible fabric web partially covering the elastic band comprising:
(i) an outer web portion; and
(ii) an inner web portion;
(c) a first securing means securing upper linear parts of the outer web portion and the inner web portion to upper linear parts of the inner surface of the elastic band;
(d) a second securing means securing lower linear parts of the outer web portion and middle linear parts of the inner web portion to the elastic band; and
(e) a third securing means securing lower linear parts of the inner web portion to lower linear parts of the outer surface of the elastic band; and
II. a trousers body with inset pockets which body is attached proximate its upper linear edge by a sixth line of stitching to the bottom linear edge of the outer web portion.

13. Trousers according to claim 12 further comprising an outlet near the rear part of said waistband structure.

14. Trousers according to claim 12 wherein said first, second, third and sixth securing means comprise first, second, third and sixth lines of stitching.

15. Trousers according to claim 12 further comprising a decorative fourth line of stitching penetrating the lower linear part of said outer fabric web portion.

16. Trousers according to claim 15 further comprising a decorative fifth line of stitching penetrating the middle linear part of said inner fabric web portion.

* * * * *